US005652999A

United States Patent [19]

Jarvis

[11] Patent Number: 5,652,999

[45] Date of Patent: Aug. 5, 1997

[54] HANDLE FOR ATTACHMENT TO VARIABLE SIZED HAND FLOATS

[76] Inventor: Jack D. Jarvis, 3204 Periwinkle, Memphis, Tenn. 38127

[21] Appl. No.: 411,322

[22] Filed: Mar. 27, 1995

[51] Int. Cl.[6] ..... B25G 1/01

[52] U.S. Cl. ..... 16/110 R; 16/DIG. 24; 404/118; 81/489

[58] Field of Search ..... 16/110 R, 114 R, 16/DIG. 24; 52/364; 404/118; 190/116, 115; 81/489

[56] References Cited

U.S. PATENT DOCUMENTS

| | | | |
|---|---|---|---|
| 3,343,634 | 9/1967 | Goldman et al. | 16/110 R |

FOREIGN PATENT DOCUMENTS

| | | | |
|---|---|---|---|
| 1507819 | 11/1967 | France | 16/110 R |
| 1513446 | 1/1968 | France | 16/114 |
| 1925232 | 9/1970 | Germany | 16/110 R |
| 953837 | 4/1964 | United Kingdom | 16/114 R |
| 2023077 | 12/1979 | United Kingdom | 16/110 R |

*Primary Examiner*—Daniel W. Howell
*Assistant Examiner*—Christopher Kirkman
*Attorney, Agent, or Firm*—Paul M. Denk

[57] ABSTRACT

A universal float handle device having a central arched gripping portion and a single foot formed at each end, each foot has formed in it one or more apertures which allows for the handle to be readily attached to a hand trowel float. The base of each foot is flat, and may have a marginal rim provided around its periphery, each foot having an aperture provided therethrough, with counterbores formed into both the bottom end and the upper end of each aperture, to provide clearance for accommodating the locating of a fastener therethrough, and for attaching the handle to a hand float. The aperture through one foot may be elongated, to provide a form of slot for accommodating adjustment in the locating of the fastener at that end, while the aperture provided at the opposite foot may comprise one or more apertures, to provide adjustment in the locating of the fastener when attaching that end of the handle to the hand float device. A plug inserts within the counterbore formed at the upper end of each aperture, and is contoured to mate flush with the upper surface of the handle, for the convenience of the user, and to enhance the appearance of the universal handle once installed and utilized.

4 Claims, 1 Drawing Sheet

HANDLE FOR ATTACHMENT TO VARIABLE SIZED HAND FLOATS

BACKGROUND OF THE INVENTION

This invention relates to improvements in the method of attaching a universal handle to a trowel float means, such as those utilized in the application of smoothing and finishing of cement and concrete, and more particularly to a method and structure whereby a single handle using a unique handle-attachment construction, may be universally applied to any and most commercially available hand float blades or devices, to provide for handle replacement when such becomes necessary, either due to breakage or deterioration of the original handle, or as may be desired by the user.

Oftentimes throughout the course of general usage of tools, particularly those types of tools that are used in more abrasive type settings, such as for manipulating and maneuvering concrete, and the like, the handles as attached to their float means are subject to wear, degradation, become damaged, and for other reasons must be replaced prior to the normally expected useful life of the float device itself. Replacement of the entire hand float unit may be costly, and also rather inefficient since the handle can be easily detached and removed from most float means. In a conventional arrangement, normally two fasteners, such as screws or bolts, or the like, attach the handle to the upper side of the float means. Each such fastener is normally slipped through the opposite end foot of the handle, and anchors the handle into threaded bores formed upon the upper body surface of the metal or wood protruding upwardly of the hand float. Since the float blades or means themselves are normally formed of metal, and are much more durable than the usually wood formed handles attached to them, most are designed to offer simple and ready handle replacement, and thus handles can be changed out multiple times during the useful life of the hand float.

Unfortunately, there presently exists no industrial configuration standards for the placement of the threaded bores upon the handle attachment, or with respect to the location of the threaded attachments normally provided upon the upper surface of the float means. Instead, each individual hand float manufacturer utilizes whatever configuration or dimensions it determines satisfactory to meet its own requirements, for attachment of its handle to the metal float. As a result, a plethora of fastener placement configurations confront any user of this type of device, and attempting to replace a nonfunctional handle, because of breakage, normally is a very difficult task, unless a replacement handle can be obtained from the same source from which the manufactured float was originally obtained. Logistic wise, this may be inconvenient.

Accordingly, availability becomes a major obstacle when attempting to replace a trowel handle. Not all retailers stock sufficient replacement handles for the hand floats that they carry, much less a full complement of replacement handles for all of the various manufactured floats that are readily available upon the market. With the wide variety of hand float designs and manufacturers of such tools that are currently on the market, retailers are simply reluctant to stock all the available replacement types of handles. Locating a nearby retailer or supplier that carries the necessary replacement handle, and to find one readily in stock, often presents an effort in frustration.

Furthermore, because of the low volume economics of stocking this type of an item, finding replacement handles for a float is usually a quite difficult task. Replacement usually becomes cost inefficient since even if an adequate replacement handle is available, the high cost of any such handle, and the cost in time invested in locating the retailer that stocks the same, often offsets the benefits of only replacing the handle itself. The user is often induced into purchasing an entirely new hand float, rather than efficiently attempting to replace an unserviceable handle on his old unit.

Beyond simply providing a serviceable replacement handle for a trowel float means, the current invention incorporates a unique, universal handle attachment design which allows for it to be connected to a wide variety of hand float devices. Thus, a single handle of the current design can be made readily available as a replacement for nearly all of the commercially available hand float devices. Retailers will not be faced with the unreasonable stocking demands, and the user will not be required to search endlessly for the exact replacement handle for a specific float means.

SUMMARY OF THE INVENTION

This invention contemplates a universal form of attachment design incorporated into the handle means of a hand float, that facilitates the convenient, stable and universal attachment of this particular handle to any of a variety of commerically available trowel or hand float devices, utilizing, as fastener means, any type of screws, bolts, or the like. The handle can be attached without requiring the application of any special adapters or other intermediate devices, and once installed, incorporates various types of plug means, overlying each fastener means cavity, formed within each foot of the handle, in order to protect the fasteners against contact with cement, concrete, or the like, to reduce their exposure to moisture, thereby reducing the incidence of oxidation, and furthermore, provides a smooth exterior surface to both the feel, and look, so as to prevent the hand of the user from being scratched, and to afford a rather smooth exterior appearance to the overall handle design, once installed upon a float blade or device.

The replacement of handle means for hand floats is well recognized as a necessity in the industry, and usually, as previously explained, since the float means, normally fabricated from a metal, regularly outlives the useful life of its handle, such a universal replacement handle is desirable. The handle means can be attached to a wide variety of floats, such as that disclosed in the present invention, regardless of their length, including those much longer type of hand floats that are used for obtaining access under normally inaccessible areas, and furthermore, this type of handle means can provide efficiency, cost effectiveness and cost reduction, and be of general convenience to the industry, for use as a means for reconditioning a hand float, once its handle has deteriorated. Obviously, while the review herein may analyze the construction, structure and usage of this current invention, from the standpoint of a hand float type of device, and its application, it is just as obvious that the universal attachment design as provided herein, and as explained in this current invention, and as incorporated into said handle means, can be used for any of a variety of handle replacement applications, whether it be for a trowel or hand float means, or for any other device needing a handle to facilitate grasping as during usage.

The handle attachment design of this particular invention employs a handle, whose midsection is generally arch shaped, to facilitate the easy grasping of the handle by the hand when applied to a float, and having a base mounting type of foot integrally formed at each end of the handle, to accommodate its attachment to the metallic portion of the hand float. Each foot of the handle employs at least one form of aperture, at one end normally being formed as a slot, so as to provide an elongated dimension in which the fastener means may be attached and adjusted, and readily mount the handle to the float, regardless how far apart the threaded apertures may be spaced, as disposed upon the top side of the float, for accommodating its original equipment handle. When the universal handle of this invention is applied to a float, it provides a spectrum of adaptability to align and attach the handle means to various types of floats, upon their upper side, and to which a handle of this type is usually attached. In addition, the apertures through each handle foot may have a variety of widths, and diameters, and are designed to function as a sleeve like means through which the fastener may locate, and for attachment to the upper side of a float means, when installed. It is recognized that as the fastener configurations of existing float means may change, such as when new models are introduced to the market, alterations to the configuration of the series of apertures and bores provided in the handle means of this invention may be required to be modified, but generally, in the standard universal handle of this design, it is fabricated to accommodate a variety of fasteners, for attachment to a variety of hand float means, regardless how far apart, within reason, the existing threaded apertures may be provided, upon the topside of the float means, as explained.

In a typical application, the handle means of this invention comprises its midsection, its integral foot extensions, the formed arch molded into the midsection of the handle, for facilitating its grasping and usage. In most instances, the integrally extending features incorporate downwardly facing bases, which are generally rectangular in configuration, and are flat and coplanar with respect to one another, so as to provide for their ready and stable attachment to the float means, during installation. As differing applications may at times dictate, the base of each foot may be of any appropriate shape and size, in order to facilitate the stable attachment of the universal handle to a hand float. Incorporated into each base, generally in alignment with its apertures, are counterbores of a depth and dimension as may be required to prevent contact between any undesirable protrusions, as may be extending upwardly from the float means, that may be a part of or be present near the attachment of the fasteners, when securing the handle to the upward side of the float means. Hence, this insures stability when the handle means is attached to the appropriate float means. Furthermore, the size and location of the counterbores are such as to yet provide sufficient surface areas, upon the bottom side of each base, so as to provide for their snug and contiguity when secured by any fastener holding the handle means to its float means. In addition, the pressure exerted by the fasteners, once secured, will be transmitted through the foot bases so as to assure snug contact between these components, that remain intact, even after repeated usage of the hand float.

Structured into the top side of each foot, at the location of the upper portion of each aperture therethrough, is another counterbore, positioned opposite of the counterbore formed on the bottom of each base, with the counterbore being so designed so as to provide sufficient clearance above the aperture to allow the fastener head to fit therein, as when the fastener secures the handle means to its float means. Furthermore, it prevents the head of the fastener from protruding upwardly above the handle surface, at the location of each foot, so as to prevent their exposure, and rubbing contact with the hand of the user of the float, when applied. In addition, and in order to add uniformity to the appearance of the handle, a plug type insert is provided for snugly fitting within each upwardly disposed counterbore, formed in each foot, and which has a uniform and smooth upper surface so as to blend directly into and be synonymous with the contours of the proximate handle, and provide for a uniform appearance to the handle in its design, and to prevent any abrasion to the hand, when the float is utilized.

Proximate the location of each plug within a counterbore, there is formed another minor slot, and into which a tool, such as a small screwdriver, pick, or nail may insert, so as to facilitate removal of the plug therefrom, as when it may be necessary to either further tighten the fasteners in place, or to remove them, in order to replace the handle with another, should that become necessary.

As a further measure of usage of this particular device, and as an improvement in its application, after said handle device has already been conveniently and snugly attached to the appropriate float means, and to protect the user's hand from abrasion, such as through repeat contact with any exposed counterbore, and to further protect the fasteners located therein, from their exposure to concrete, cement, or other forms of moisture, and also to enhance the aesthetic appearance of the handle device, these plug means as devised slip snuggly into and fill the entire opening of the upperwardly disposed counterbore, as formed in the upward side of each of the handle foot. In order to achieve a snug fit, the side walls of the plug means generally match, or may be slightly tapered, and oversized in comparison therewith, to the formed counterbore, so that when the plug is forced into place, it is snugly held in position, with its upper surface blending into the contour of the surrounding handle. The base of each plug means is likewise counterbored, and has such dimension so as to possibly allow for contact between this aspect of the plug means, and the head of any fastener, and to prevent the fastener from turning in place, through repeated usage of the float means, and thereby prevent the handle from loosening from its tightened condition with the attached float.

One of these apertures provided through an integral foot of the handle may be formed as an elongated slot, in order to accommodate the locating of a fastener therein, anywhere along the length of said slot, so as to allow for clearance and adjustment between the various threaded apertures provided at the topside of the variety of float means, and to which this universal handle may be applied.

In its installation, the handle means of this invention may be aligned upon the topside of any float means, after the float means has been reasonably cleaned, and cleared of any hardened cement, or the like, and with the plugs of the handle feet having been previously removed, threaded fasteners may be located therethrough, and threadedly engaged within the pair of spaced threaded openings provided upon the upper surface of the float means to which the handle is to be attached. Then, through the use of a screwdriver, wrench, or the like, the fasteners may be snugly tightened into position, at their adjusted and aligned locations through each foot of the handle means, at which time, the two plug means may be relocated into their respective counterbores, and tightly forced into engagement, to complete the installation of the universal handle to its float means. Once installed, the plugs lie flush with the outer contour of the handle, to provide a smooth and uniform appearance to the handle means.

DESCRIPTION OF THE PREFERRED EMBODIMENT

Figure 1:
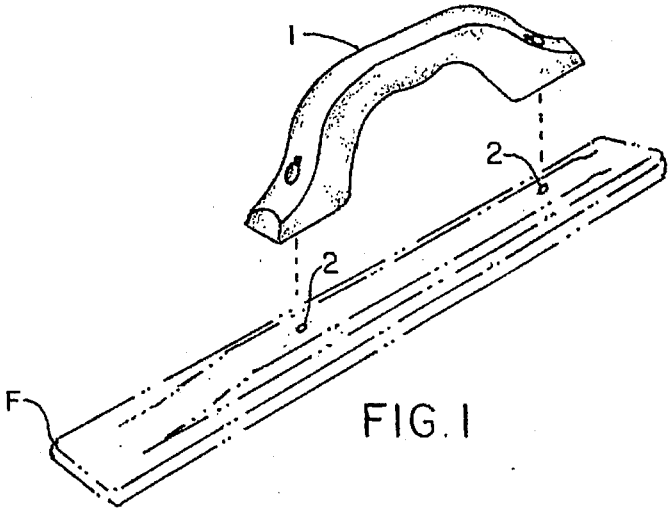
FIG. 1 is a phantom line view of a float means blade, disclosing its various arranged apertures, and showing, in exploded view, the handle means of this invention during its alignment for installation.
Figure 5:
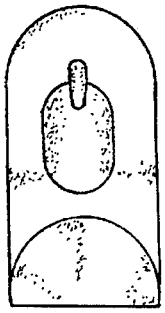
FIG. 5 is an end view of the handle means.

In referring to the drawings, and in particular FIG. 1, the handle means 1 of this invention is disclosed, as in alignment with the various threaded openings or apertures, as at 2, provided upon the upper surface of the float blade or means F of this invention. As shown particularly in FIGS. 2 through 4, the designed means for attachment of the handle of this invention is quite clearly disclosed. As can be seen, and in the preferred embodiment, the handle is formed incorporating an arched midsection, as at 3, the dimensions being such that the handle may be readily grasped by the hand of the user of this device, affording sufficient clearance, as at C, between the handle's midsection and the float means of this invention. At each end of the handle means is formed and extends an integral foot portion, as at 4 and 5, both extending outwardly of the handle, and downwardly from the arched center or midsection of the handle, with each foot forming a base portion 6 and 7, as disclosed. These comprise the base for the arching portion of the handle, and which lie upon or form a planar segment which can be mounted flush against the upper surface of the float means F, when installed.

Figure 2:
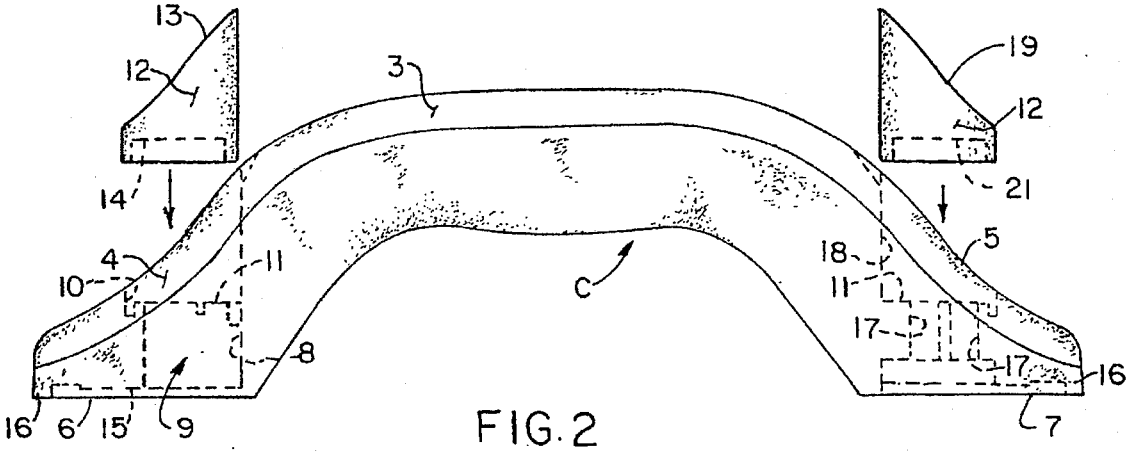
FIG. 2 is a side view of the handle means of this invention, showing the plug means raised in spaced relation thereto, and further showing, in hidden line, the various apertures and counterbores provided through each foot of the said handle means.

As can be further seen in FIG. 2, the first foot portion 4, includes an aperture, as at 8, provided therethrough, and which extends from the upper surface of the handle, through its base 6, for reasons to be subsequently described. This particular aperture 8 may be formed as an elongated slot, as can be seen at 9, and which provides adequate clearance for locating of a fastener means therethrough, such as a screw, so that the handle can be applied to a float means having sufficient clearance regardless where the fastener means may attach into the threaded openings 2 provided upon the upper surface of the variety of float deans F, as available in the trade. An upper counterbore, as at 10, is provided communicating with the upper end of the slot or aperture 9, and which counterbore extends up to the upper surface of the handle 1. There is a shoulder, as at 11, formed between the counterbore 10, and the slot 9, so that the head of any screw located therein will bind against the shoulder 11, when tightened in the handle to its float means F. Once a fastener is located, a plug 12 is designed for tightly and snuggly fitting within the counterbore 10, so as to shield, shelter, and conceal the head of the fastener, once tightened, and likewise, the upper surface, as at 13, of the plug uniformly mates with the contours of the upper surface of the handle 3, at the location of the foot 4, so as to provide a smooth and uniform appearance, and to prevent any abrasion to the hand, when the tool is used. The bottom of each plug also includes a slight upwardly extending counterbore, as at 14, so as to provide clearance for the head of any screw fastened therein, once installed. The bottom of the aperture or slot 9 includes a further counterbore formed therein, extending as at 15, upwardly from the base 6, and which provides a circumferential or peripheral rim or marginal flange, as at 16, that may snugly rest upon the upper surface of the float means F, once the handle is installed.

As can be seen at the opposite end of the handle 1, as at the foot 5, there are provided one or more apertures 17 therethrough, so that a fastener may insert through one of said apertures, when initially aligning the handle means 1 into position upon a float means, for replacement and installation of its handle. A similar type of counterbore, as at 18, is provided upwardly of the apertures 17, and extends through the top of the foot portion 5, for the same purpose as previously explained, for providing the insertion of at least one fastener means therethrough, for securing into a threaded opening, as at 2, proximately disposed upon the upper surface of the float means F. Also, another plug 19 is provided at this location, for snugly inserting within the counterbore 18, and to seal it, once a fastener is installed. In addition, a second counterbore 21 is provided extending slightly upwardly within the bottom of the plug 19, once again for furnishing clearance to the head of any fastener located therein. In addition, these counterbores may have sufficiently designed dimensions, so that the side of the counterbore may snugly rest against the head of the fastener located therein, so as to prevent its turning, or loosening, during repeated usage of the float means, and to insure a more permanent installation of the handle means 1 thereon, once replaced and installed.

Figure 3:
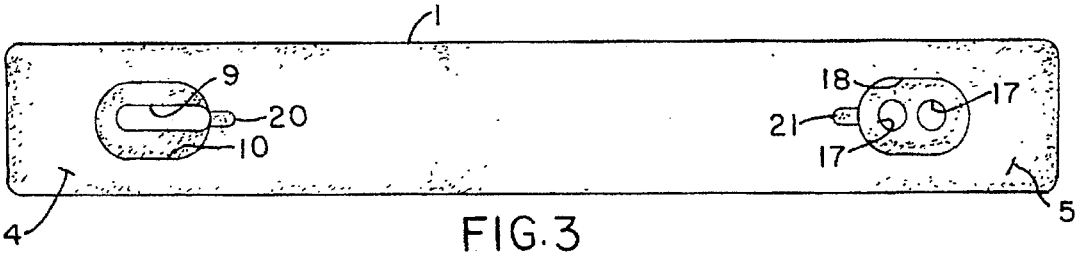
FIG. 3 is a top plan view of the handle means.

In referring to FIG. 3, the location of the apertured slot, as at 9, within the upwardly disposed counterbore 10, is readily seen, as formed within the handle means 1. Also, at the other foot 5, the pair of apertures 17, within the upwardly disposed counterbore 18, is likewise shown. As can also be seen from this figure, and likewise in referring to FIG. 2, there is a slight clearance opening, as at 20, associated with each of the counterbores 10 and 18, and these slight clearance slots are provided for insertion of any type of a small screwdriver, pick, nail, or other instrument therein, and which can be used for prying opening and freeing the plugs 12, from within a handle, when it is necessary to attain access to the fastening means, whether it be to remove them, or to further tighten them into place.

Figure 4:
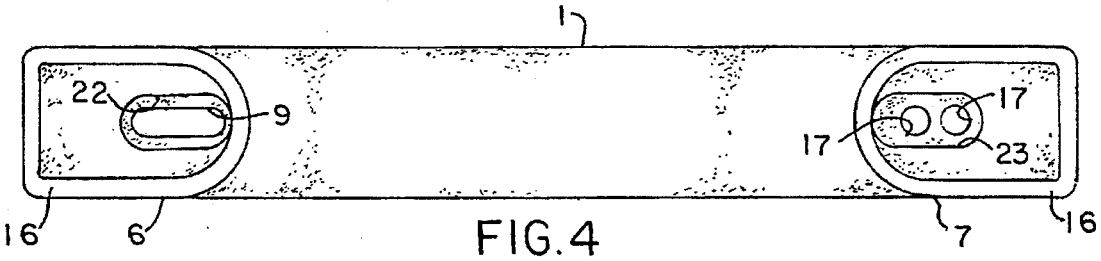
FIG. 4 is a bottom view of the handle means.

FIG. 4 provides a bottom view of the handle means 1, and as can be seen, the slotted aperture 9 in addition to the apertures 17, are readily disclosed. Additional counterbores are provided at the bottom of each of these slots, as at 22 and 23, to provide further clearance to the bottom of the fastener means, as they are located through their respective slots, and when attached to the threaded openings 2 of the float means. In addition, and as previously explained, in order to provide snug contact of the handle means with the surface of the float means, a marginal rim, as at 16, is provided around each of the bases 6 and 7 of the handle feet, to afford a rim like contact area for engagement with the upper surface of the float means F, when securing the handle in place.

Figure 6:
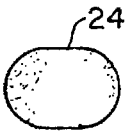
FIG. 6 is a top of a plug.
Figure 7:
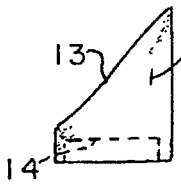
FIG. 7 is a side view of a plug.
Figure 8:
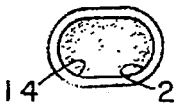
FIG. 8 is a bottom view of a plug for pressing within the upper counterbore of a handle means foot.

FIGS. 6 through 8 disclose the plug means 12 and how their upper surfaces, as at 13, are contoured for mating with the contiguous upper surface of the handle means, so as to afford a smooth transition between the handle surface, and the plug, once it has been installed. From the top, as shown in FIG. 6, each plug has an oval figuration, as at 24, so as to assure its locating within the upper counterbore 10, or 18, provided in the handle means 1. (See FIG. 3). At the bottom, as further previously explained, each of the plugs has a counterbore 14, or 21, which provides clearance for the head of the proximate fastener, as it rests upon the formed shoulders 11, provided within each of the feet 4 and 5, of the handle means 1.

Although the preferred embodiment of this invention incorporates single or double slotted bores or apertures, through each of the feet of the formed handle, it is possible that the number of apertures, or the dimensions of the apertures provided within the counterbores, may vary in different embodiments due to the type of application to be made of the handle means of this invention. Furthermore, in accordance with this invention, the lower bases 6 and 7 of each foot may be readily designed and machined to conform to the cross-sectional topography of the underlying float means to which it will attach, regardless whether the upper surface of the float means may be flat, concave, convex, or otherwise arcuate, to assure that snug retention can be made of the handle means to the float means, once installed. Numerous variations in the configuration and construction of the handle means of this invention, within the scope of the appended claims, may occur to those skilled in the art in light of the foregoing disclosure. Such variations or modifications, if within the spirit of this invention, are intended to be encompassed within the scope of any claims to patent protection issuing upon this development. The description of the preferred embodiment set forth herein is done so for illustrative purposes only.

Having thus described the invention, what is claimed and desired to be secured by Letters Patent is:

1. A universal handle for attachment to any of a variety of hand float devices, said handle having a length to extend a distance with respect to the hand float device, said handle having a midsection and an aligned integral first and second foot portions, one formed at each end, said midsection of the handle being arched to facilitate its grasping, each foot portion having a lower base for flush mounting upon the hand float, each foot portion having at least one aperture provided therethrough, each formed aperture having a counterbore extending inwardly of the base of the foot, each said foot having a second counterbore extending downwardly from the upward end of each foot aperture, each said aperture disposed for accommodating a fastener for securing the hand float to the handle, and a plug means for insertion into each said second counterbore to seal off said fastener once the handle is attached to the hand float, one of said apertures of the first foot portion being formed as an elongated slot to accommodate the locating of the fastener at select locations along the length of the slot to accommodate the attachment of the universal handle to a hand float device, said second counterbore extending downwardly from the slot formed aperture having corresponding length, and the plug means being elongated to provide for its insertion within said length of second counterbore to provide closure for the aperture once the handle is fastened to the hand float device, the other of said apertures of the second foot portion comprising a pair of apertures provided through the second foot portion of the handle to provide major adjustment in the initial locating of the fastener when attaching the handle to the hand float device, the second counterbore provided upon the other aperture also being formed elongated, and its plug means likewise being elongated to provide for its insertion within said second counterbore to provide closure for the pair of apertures provided through the associated foot, and wherein each plug means having a further counterbore formed therein to accommodate the locating of the head of any fastener when attaching the universal handle to the hand float device.

2. The invention of claim 1 and including a clearance slot provided laterally of each second counterbore to provide location for insertion of a tool for removal of a plug means when the handle is to be removed from a hand float device.

3. The invention of claim 1 and wherein each foot having a downwardly extending flange around its lower perimeter to provide clearance when mounting of the universal handle to a hand float device.

4. The invention of claim 1 wherein said universal handle being formed of one of metal and plastic.

* * * * *